US005828924A

United States Patent [19]

Fukada et al.

[11] Patent Number: 5,828,924

[45] Date of Patent: Oct. 27, 1998

[54] OPTICAL DETECTING DEVICE FOR AN IMAGE FORMING APPARATUS AND AN IMAGE FORMING APPARATUS USING THE SAME

[75] Inventors: Satoshi Fukada; Nobuo Hyakutake; Kenji Tomizawa; Junichirou Sameshima; Mikio Kobayashi; Norio Hokari; Yukio Hayashi; Shuji Iseki; Ryoichi Tsuruoka, all of Ebina, Japan

[73] Assignee: Fuji Xerox Co., Ltd., Tokyo, Japan

[21] Appl. No.: 727,991

[22] Filed: Oct. 10, 1996

[30] Foreign Application Priority Data

Oct. 12, 1995 [JP] Japan ..... 7-264075

[51] Int. Cl.[6] ..... G03G 15/00; G03G 21/16

[52] U.S. Cl. ..... 399/16; 399/22; 399/98; 399/111; 250/200; 250/559.4

[58] Field of Search ..... 399/21, 22, 16, 399/111, 98, 99, 72; 250/559.4, 559.39, 200, 201.1

[56] References Cited

U.S. PATENT DOCUMENTS 4,239,372 12/1980 Iwai .
5,073,795 12/1991 Nukaya .
5,084,627 1/1992 Ueki et al. ..... 250/561
5,270,784 12/1993 Nakane et al. .
5,613,174 3/1997 Denton et al. ..... 399/98

FOREIGN PATENT DOCUMENTS

A-54-136843 10/1979 Japan .
A-55-48769 4/1980 Japan .
A-4-72251 3/1992 Japan .

*Primary Examiner*—R. L. Moses
*Attorney, Agent, or Firm*—Oliff & Berridge, PLC

[57] ABSTRACT

In an optical detecting device, used for an image forming apparatus, for detecting an object to be detected, such as a paper, by an optical means including a light emitting means 20c, a photo sensing means 20d, a reflecting means 20b, and the like, there is provided at least one of a paper detecting devices in which conductive attracting means connected to a predetermined potential is disposed close to the optical means, the optical means is attached to a periodical replacing component of the image forming apparatus, a reflecting means 20b and a paper transporting path are oriented in different directions with respect to a photo sensing means 20d and a distance from the light emitting means 20c and the like to the reflecting means 20b is different from a distance from the light emitting means 20c and the like to the paper transporting path.

12 Claims, 6 Drawing Sheets

OPTICAL DETECTING DEVICE FOR AN IMAGE FORMING APPARATUS AND AN IMAGE FORMING APPARATUS USING THE SAME

BACKGROUND OF THE INVENTION

The present invention relates to an optical detecting device for an image forming apparatus, such as a copying machine and a color printer, and an image forming apparatus using the optical detecting device. More particularly, the invention relates to an optical detecting device for detecting papers being transported in the image forming apparatus, a toner image on an image carrying body, and objects to be detected, such as registration marks of the image carrying body and an image transferring body, and an image forming apparatus using the optical detecting device.

A known image forming apparatus is composed of a toner image forming section, a toner image transferring section, and a toner image fixing section. The toner image forming section is provided for forming toner images of different colors. The toner image transferring section is for transferring the formed color toner images onto a paper. The toner image fixing section is for fixing the toner images on the paper in the form of a color picture. By repeating the process of forming and transferring the toner images, toner images of a multiple of colors are formed on the paper, and then the multi-color toner images are fixed on the paper.

More specifically, as shown in FIG. 9, the toner image forming section has two functions, an image forming function and a cleaning function. The image forming function is executed by a photoreceptor drum 51, a uniform charging means 52 for uniformly charging the surface of the photoreceptor drum 51 to set up a potential uniformly distributed over the drum surface, an exposure means 53 for forming a latent image on the photoreceptor drum 51 by irradiating the drum surface with light containing image information, a developing means 54 for developing the latent image with toner of predetermined colors to form color toner images, and a pre-transfer charging means 55 for adjusting the charged potentials of the toner images. With those components, toner images of the respective colors are formed on the surface of the photoreceptor drum 51. The cleaning function is executed by a pre-cleaning discharging means 56 for discharging the toner left on the photoreceptor drum 51 after the toner images are transferred from the photoreceptor drum 51 onto a paper, and a photoreceptor cleaning means 57 for removing the residual toner from the photoreceptor drum 51. With those components, the surface of the photoreceptor drum 51 is cleaned every time the toner image being transferred onto the paper, in preparation for the next toner image forming operation.

The toner image transferring section has an image transferring function and a discharging function. The image transferring function is executed by an image transferring drum 58, an attracting means 59 for causing the image transferring drum 58 to attract the paper thereonto, a transferring means 60 for transferring the toner image on the paper, the transferring means 60 being opposed to the photoreceptor drum 51 with the shell of the image transferring drum 58 placed therebetween, and a detachment means 61 for detaching the paper carrying the multi-color image off the transferring drum 58. With those components, a multi-color image is transferred onto a paper by turning the transferring drum 58 with the paper attractively put thereon a preset number of times. The discharging function is executed by a drum discharging means 62 for discharging the surface of the transferring drum 58 after the paper is detached from the drum surface. The drum discharging means discharges the surface of the transferring drum 58 every time the paper is detached from the drum surface in preparation for the transferring of the toner image on the next paper.

The toner image fixing section includes a heating roll 66 containing a heater therein, and a pressure roll 67 brought into contact with the heating roll 66. The paper on which the multi-color toner image is formed is passed between the rolls 66 and 67, to thereby fix the toner image on the paper.

In the image forming apparatus, the photoreceptor drum 51, the uniform charging means 52, the pre-transfer charging means 55, the pre-cleaning discharging means 56, the photoreceptor cleaning means 57, and the like are assembled into a photoreceptor cartridge. The transferring drum 58, the attracting means 59, the transferring means 60, the detachment means 61, the drum discharging means 62, the toner image fixing section (66, 67), and the like are assembled into an image transferring cartridge. These cartridges are detachably set to the main body of the image forming apparatus, and periodically replaced with new cartridges.

In the image forming apparatus, an optical density of the toner image on the photoreceptor (image carrying means) drum 51 is measured, and a developing density when the developing means 54 is operated is adjusted on the basis of the result of the density measurement. Further, a sequence of image forming operations is controlled with a turn of the transferring drum 58.

Further, the image forming apparatus includes optical means disposed in opposition to the photoreceptor drum 51, an optical detecting device for optically detecting a toner image formed on the photoreceptor drum 51 and producing a signal based on a toner density, another optical means disposed in opposition to the transferring drum 58, and another optical detecting device for optically detecting registration marks formed on the image transferring drum 58 and producing detecting signals.

In operation, a paper is taken out of a paper tray, not shown, and transported to the image transferring drum 58. The paper is attractively put on the image transferring drum 58, and turned a preset number of turns with the turn of the image transferring drum 58. Finally, the paper is detached from the image transferring drum 58 and discharged out of the apparatus, through the toner image fixing section (66, 67). This is a normal paper transporting path. The image forming apparatus further includes a paper transporting path, which is provided for a paper mistakenly transported, as in a case where a paper is attracted onto the photoreceptor drum 51. A registration roll 64 is provided between the paper tray and the image transferring drum 58. The registration roll 64 adjusts a timing at which the image transferring drum 58 attracts a paper so that a toner image formed on the photoreceptor drum 51 reaches the image transferring position, while at the same time a paper formed on the image transferring drum 58 reaches the image transferring position.

The image forming apparatus uses optical detecting devices to properly transport a paper. The optical detecting devices detect a paper in the paper transporting path and the like in order to check whether or not a paper is properly transported, and whether or not a paper not properly transported is perfectly removed. More specifically, a first optical detecting device 68 for detecting whether or not a paper has been supplied to the nip between the registration roll 64 and the paper tray is located between the registration roll 64 and the paper tray. A second optical detecting device 69 for detecting whether or not a paper has been attracted by and put on the image transferring drum 58 is located between the attracting means and the image transferring means. A third optical detecting device 70 for detecting whether or not a paper is attracted by the image transferring drum 58 after the image transferring operation, is located between the image transferring means 60 and the detachment means 61. A fourth optical detecting device 72 for detecting whether or not a paper is detached is located between the detachment means 61 and the drum discharging means 62. A fifth optical detecting device 71 is located between the detachment means 61 and the toner image fixing section (66, 67). The fifth optical detecting device 71 is provided for detecting whether or not a paper has been detached the image transferring drum 58.

A transmission type of optical detecting device is disclosed in Unexamined Japanese Patent Publication Nos. 55-48769 and 4-72251, for example. In this type optical detecting device, a light emitting means and a photo sensing means are disposed in opposition to each other with respect to the paper transporting path. An optical path for detecting the paper is set up which intersects the paper transporting path. The transmission type of the optical detecting device detects whether or not the paper is present depending on the presence or absence of light sensed by the photo sensing means. When the optical detecting device is used for paper detection, the paper detection is generally performed in the following way. A threshold level is set between a quantity level of light sensed when a paper is present and that when no paper is present. When a quantity level of light actually sensed is above the threshold level, it is judged that no paper is present, and when it is below the threshold level, it is judged that a paper is present.

A reflection type of optical detecting device is disclosed in Unexamined Japanese Patent Publication 54-136843. This type optical detecting device includes a light emitting means disposed facing the paper transporting path, a reflecting means for reflecting light from the light emitting means, and a photo sensing means for sensing light from the reflecting means, the photo sensing means being disposed in opposition to the reflecting means with respect to the paper transporting path. A paper detecting optical path is set up which intersects the paper transporting path. The optical detecting device detects whether or not a paper is present depending on a quantity of light sensed by the photo sensing means. In the reflection type of the optical detecting device, the reflectivity of the reflecting means is set to be lower than that of the paper. A threshold level is set between a quantity level of light sensed when a paper is present and that when no paper is present. When a quantity level of light actually sensed is above the threshold level, it is judged that a paper is present, and when it is below the threshold level, it is judged that no paper is present.

The light emitting means, the photo sensing means and the reflecting means form the optical means.

In the optical detecting device of each of those image forming apparatuses, floating toner scattered from the toner image on the paper adheres to the surface of the optical means. In this case, the quantity of light received by the photo sensing means is decreased. This makes it impossible to exactly detect the detected object on the basis of the threshold level within a short period of time. In a situation where the quantity of light reflected by the paper lowers to below the threshold level and no paper is present, the transmission type of detecting device, for example, when it is used for detecting the paper, mistakenly recognizes that the paper is present. To avoid this, a maintenance to wipe out the surface of the optical means, to replace the optical means with a new one, and the like must be repeated for relatively short time intervals. Particularly, when the transmission type detecting device is used, the characteristic deterioration owing to the adhesion of dirt onto the optical means is remarkable in the optical means which is disposed facing the surface of the paper where the toner image is formed.

In the image forming apparatus, particularly a color image forming apparatus, a color copy paper as well as a normal white paper is used. Sometimes images of high density are formed on both sides of the paper, and the reflectivity values of the papers used for the image forming apparatus are distributed over a broad range. Where the reflection type optical detecting device is used for detecting the paper, a difference between the quantity of light from a paper of low reflectivity that is received by the photo sensing means and the quantity of light reflected by the reflecting means that is received by the same is small. Therefore, it is very difficult to set up a threshold level between those reflected light quantities, and hence to accurately detect the paper depending on the threshold level. To detect the paper by using the reflection type optical detecting device, it is necessary to position the related means with high precision, and to maintain the matching of the characteristics of the light emitting means and the photo sensing means. For this reason, it is essential to adjust the mutual positions of the light emitting means, the photo sensing means and the reflecting means, and to assemble those means into one cartridge.

Also in the transmission type of the optical detecting device, the light emitting means and the photo sensing means must be disposed with high precision in order that light emitted from the light emitting means properly hits the photo sensing means. This necessitates the adjustment of the mutual positional relationship between the light emitting means and the photo sensing means, and the assembling of them into one cartridge.

Accordingly, an object of the present invention is to provide an optical detecting device which is used for an image forming apparatus and accurately detects an object to be detected, and an image forming apparatus using the optical detecting device.

SUMMARY OF THE INVENTION

The first aspect of the invention provides an optical detecting device for an image forming apparatus, which optically detects an object to be detected by optical means disposed facing a moving path of the detected object. In the optical detecting device, a conductive attracting means is connected to a predetermined potential and disposed close to the optical means.

The second aspect of the invention provides an optical detecting device for an image forming apparatus, which optically detects an object to be detected by optical means disposed facing a moving path of the detected object. In the optical detecting device, the optical means is attached to a periodical replacing component of the image forming apparatus.

The third aspect of the invention provides an optical detecting device for an image forming apparatus comprising a light emitting means disposed facing a paper transporting path, a reflecting means for reflecting light emitted from the light emitting means by the reflecting surface thereof, the reflecting means being disposed in opposition to the light emitting means with respect to the paper transporting path, and a photo sensing means for sensing light reflected by the reflecting surface of the reflecting means, the photo sensing mean being disposed in opposition to the reflecting means with respect to the paper transporting path, wherein an optical path for paper detection that intersects the paper transporting path is set up, and presence or absence of a paper is judged depending a quantity of light received by the photo sensing means. In the optical detecting device, the reflecting means is disposed such that the photo sensing means is positioned in the direction maximizing a quantity of light reflected by the reflecting means, and the paper transporting path is disposed such that the photo sensing means is not positioned in the direction maximizing a quantity of light reflected by the paper.

The fourth aspect of the invention provides an optical detecting device for an image forming apparatus comprising a light emitting means disposed facing a paper transporting path, a reflecting means for reflecting light emitted from the light emitting means by the reflecting surface thereof, the reflecting means being disposed in opposition to the light emitting means with respect to the paper transporting path, and a photo sensing means for sensing light reflected by the reflecting surface of the reflecting means, the photo sensing mean being disposed in opposition to the reflecting means with respect to the paper transporting path, wherein an optical path for paper detection that intersects the paper transporting path is set up, and presence or absence of a paper is judged depending a quantity of light received by the photo sensing means. In the optical detecting device, the reflecting means is located at or in the vicinity of a place where the direction maximizing the quantity of light emitted from the light emitting means intersects the direction maximizing the quantity of light received by the photo sensing means, and the paper transporting path is disposed while being spaced from the reflecting means.

In the invention thus constructed, the object to be detected or the detected object may be any thing that can be optically detected. Some examples of it are a paper, toner images on the image carrying means, and the registration marks of the image carrying means and the image transferring means.

The optical means may be any device that can optically detect the detected object disposed facing the moving path of the detected object. Some examples of it are the light emitting means, the photo sensing means, and the reflecting means.

The light emitting means may be any device that can emit light, such as a photo transistor and a photo diode. The photo sensing means may be any means capable of outputting a signal that is variable in accordance with the quantity of light received. A typical example of it is a photo sensor.

In the first aspect of the invention, the attracting means may be made of a conductive material, such as metal or conductive plastic.

The attracting means may be connected to a predetermined potential and disposed close to the optical means. A specific example of the attracting means may be a conductive plate which is earthed and disposed between the paper transporting path and the optical means. When the conductive plate, or the attracting means, is disposed between the paper transporting means and the optical path of light used for paper detection, an opening is formed in the conductive plate so as not interrupt the optical path.

In the optical detecting device of the first invention, the conductive attracting means connected to a predetermined potential is disposed close to the optical means. The attracting means electrostatically attracts dusty particles including toner floating in the space near the optical means. Particularly in case where the attracting means is disposed between the paper transporting means and the optical means, most of toner emanating from the paper moving along the paper transporting path is attracted to the attracting means.

In the second aspect of the invention, the optical means is attached to a periodical replacing component of the image forming apparatus, and may be formed integral with the periodical replacing component.

Since the optical means is attached to a periodical replacing component of the image forming apparatus, the optical means can be replaced with a new one by replacing the periodical replacing component with a new one.

In the third aspect of the invention, the reflecting means is disposed relative to the reflecting means such that the photo sensing means is positioned in the direction maximizing a quantity of light reflected by the reflecting means.

Further, the photo sensing means is disposed relative to the paper transporting path such that the photo sensing means is positioned in a direction except the direction maximizing a quantity of light reflected by the paper.

Furthermore, the reflecting means is disposed such that the photo sensing means is positioned in the direction maximizing a quantity of light reflected by the reflecting means, and the paper transporting path is disposed such that the photo sensing means is not positioned in the direction maximizing a quantity of light reflected by the paper. Therefore, a difference between the quantity of light reflected by the reflecting means and the quantity of light reflected by the paper, both reflecting light being received by the photo sensing means, may be set to be larger than a difference between the maximum quantity of light reflected by the reflecting means and the maximum quantity of light reflected by the paper.

In the fourth aspect of the invention, the photo sensing means, the light emitting means and the reflecting means are mutually disposed such that the reflecting means is located at or in the vicinity of a place where the direction maximizing the quantity of light emitted from the light emitting means intersects the direction maximizing the quantity of light received by the photo sensing means. Generally, the reflecting means may be disposed at a place where the optical axis of the light emitting means intersects the optical axis of the photo sensing means.

Also in the fourth invention, the paper transporting path may be disposed while being spaced from the reflecting means.

In the optical detecting device of the fourth aspect of the invention, since the reflecting means is located at or in the vicinity of a place where the direction maximizing the quantity of light emitted from the light emitting means intersects the direction maximizing the quantity of light received by the photo sensing means, and the paper transporting path is disposed while being spaced from the reflecting means. Therefore, the difference between the quantity of light reflected by the reflecting means and the quantity of light reflected by the paper, both reflecting light being received by the photo sensing means, is larger than that obtained when the reflecting means and the paper are located at the same position.

In the optical detecting devices of the third and fourth aspects of the invention, the reflecting means may be a reflecting plate, e.g., a mirror finished, metal plate widely used. Since the difference between the quantity of light reflected by the reflecting means and the quantity of light reflected by the paper, both reflecting light being received by the photo sensing means, is large, the reflecting means may have a two-layered structure in which a semitransparent layer is formed on the reflecting surface of the reflecting plate. The reflecting surface may be a layer that is semitransparent and reflects rays of light in a diffused fashion. A specific example of it is a semitransparent film, e.g., Mending Tape (trade mark) by Sumitomo 3-M corporation in Japan). The reflecting surface may be plane, convex or concave. In the above-mentioned member the direction maximizing the quantity of the reflecting light is substantially the same as the direction of the regular reflection light component.

The reflecting means, which has such a structure that a semitransparent layer is formed on the reflecting surface of the reflecting plate, somewhat reduces the quantity of the regular reflection component, and the difference between the quantity of light reflected by the reflecting means and the quantity of light reflected by the paper, both reflecting light being received by the photo sensing means. However, the semitransparent layer has a function to increase the quantity of the scattered reflection light to thereby suppress a variation of the reflecting light in a predetermined direction, which is caused by a minute angle variation of the orientation of the reflecting surface. For this reason, in the reflecting means having a semitransparent layer layered on the reflecting surface of the reflecting plate, a required accuracy of the orientation of the reflecting means placed with respect to the light emitting means and the photo sensing means may be relatively rough.

In installing the optical detecting devices of the third and fourth inventions in the image forming apparatus, the reflecting means may be assembled into the same cartridge as of the light emitting means and the photo sensing means, as in the conventional device. If required, the reflecting means may be assembled into a cartridge that is different from that of the light emitting means and the photo sensing means since the difference between the quantity of light reflected by the reflecting means and the quantity of light reflected by the paper, both reflecting light being received by the photo sensing means, is large.

In case where the reflecting means may be assembled into a cartridge that is different from that of the light emitting means and the photo sensing means, the difference between the quantity of light reflected by the reflecting means and the quantity of light reflected by the paper, both reflecting light being received by the photo sensing means, is reduced by a quantity corresponding to an accuracy of the mutual positioning of those cartridges. This is disadvantageous, but it is canceled by the following advantage. If one of those means is abnormal, only the abnormal means can be replaced with a normal one. Further, in this case, there is no need of an adjusting work to match the characteristics of those means.

Also in this case, viz., the case where the reflecting means may be assembled into a cartridge that is different from that of the light emitting means and the photo sensing means, it is preferable to employ the two-layered structure consisting of a semitransparent layer formed on the reflecting surface of the reflecting plate for the reflecting means. The use of the structure suppresses a variation of the reflecting light in a predetermined direction, which is caused by a variation of the orientation of the reflecting surface placed.

In installing the optical detecting devices of the third and fourth aspects of the invention, in the image forming apparatus, the optical detecting device may be disposed so as to detect one paper transporting path. Since the difference between the quantity of light reflected by the reflecting means and the quantity of light reflected by the paper, both reflecting light being received by the photo sensing means, is large, it may be disposed for detecting a plural number of paper transporting means.

In a case where a plural number of paper transporting paths are detected by one optical detecting device, the reflecting means must be disposed while spaced from the light emitting means and the photo sensing means. The result is elongation of the optical path from the light emitting means to the photo sensing means, and hence reduction of the difference between the quantity of light reflected by the reflecting means and the quantity of light reflected by the paper, both reflecting light being received by the photo sensing means. This disadvantage may be canceled by the simplified construction gained by reducing the number of optical detecting devices, however.

In the case where a plural number of paper transporting paths are detected by one optical detecting device, a two-layered structure having a semitransparent layer formed on the reflecting surface of the reflecting plate may be used for the reflecting means. A variation of the reflecting light in a predetermined direction, which is caused by a variation of the orientation of the reflecting surface placed, can be reduced if the reflecting means is disposed while spaced from the light emitting means and the photo sensing means.

A paper transporting path for a paper attracted to the image transferring means and a paper transporting path for a paper to be attracted to the image transferring means are selected for the plural number of paper transporting paths or the paper transporting path for a paper attracted to the image transferring means and a paper transporting path for a paper detached from the image transferring means may be selected for the same. In this case, the space between those paper transporting paths is narrow. Therefore, the optical detecting device is disposed closer to the attracting position where the paper is attracted to the image transferring means or the detachment position where the paper is detached from the image carrying means than in a case where two optical detecting devices are provided for those paper transporting paths, respectively.

The reflecting means of the optical detecting device may be disposed facing the light emitting means and the photo sensing means with respect to a paper transporting path for a paper attracted to the image transferring means and a paper transporting path for a paper to be attracted to the image transferring means, or the paper transporting path for a paper attracted to the image transferring means and a paper transporting path for a paper detached from the image transferring means. In this case, the optical detecting device detects the paper after the paper twined around the image carrying means is removed from the image carrying means and/or after the power switch of the image forming apparatus is turned on. On the basis of the result of the detection, it is possible to check as to whether or not the paper which twines around the image carrying means is surely removed from the image carrying means.

DETAILED DESCRIPTION OF PREFERRED EMBODIMENTS

The preferred embodiments of the present invention will be described with reference to the accompanying drawings.

First Embodiment

Figure 1:
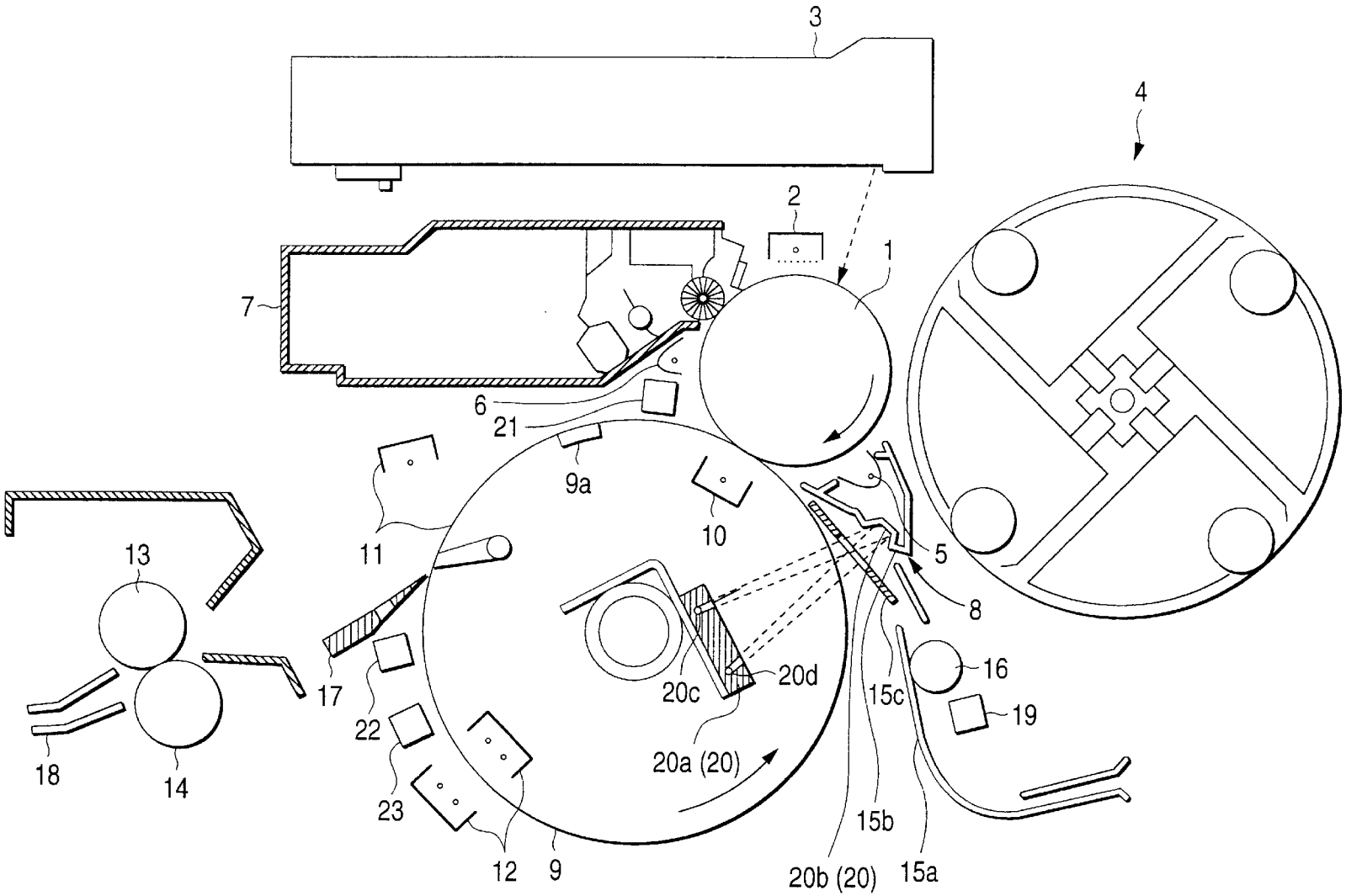
FIG. 1 is a front view showing a full color image forming apparatus according to a first embodiment of the present invention.

FIG. 1 is a front view showing a full color image forming apparatus according to a first embodiment of the present invention.

The image forming apparatus is composed of a toner image forming section, a toner image transferring section, and a toner image fixing section. The toner image forming section forms toner images of yellow, magenta, cyan and black. The toner image transferring section transfers the formed color toner images onto a paper. The toner image fixing section fixes the color toner images on the paper in the form of a color picture.

The toner image forming section includes a photoreceptor 1 in the form of a drum, a charging scorotron 2 for uniformly charging the surface of the photoreceptor 1 to set up a potential uniformly distributed over the surface of the photoreceptor 1, an exposure means 3 for forming a latent image on the photoreceptor 1 by irradiating the drum surface with light containing image information, a rotary type developing unit 4 for developing the latent image with toner of predetermined colors to form color toner images, a pre-transfer charging corotron 5 for adjusting the charged potentials of the toner images, a pre-cleaning discharging corotron 6 for discharging the toner left on the photoreceptor drum 1 after the toner images are transferred from the photoreceptor drum 1 onto a paper, and a photoreceptor cleaning means 7 for removing the residual toner from the surface of the photoreceptor drum 1. An air duct 8 is provided covering the pre-transfer charging corotron 5. Discharging products and floating toner particles, which are generated by the corotron discharging, are discharged into the outside of the apparatus by the air duct 8.

The toner image transferring section includes an image transferring drum 9, an attracting-transferring corotron 10 for causing the image transferring drum 9 to attract the paper thereto and transferring the toner images onto the paper, the corotron 10 being disposed in opposition to the photoreceptor 1 with respect to the image transferring drum 9, a detachment means 11 for detaching the paper carrying the multi-color image off the image transferring drum 9, and a discharging corotron 12 for discharging the image transferring drum 9 after the paper is detached from the drum. A position between the photoreceptor 1 and the image transferring drum 9 will be referred to as an attracting-transferring position.

The toner image fixing section includes a heating roll 13 containing a heater therein, and a pressure roll 14 pressed against the heating roll 13.

The full color image forming apparatus includes paper guiding means 15 for guiding a paper that is discharged from a paper tray, not shown, to the attracting-transferring position, a registration roll 16 for supplying the paper to the attracting-transferring position in synchronism with the timing of forming the toner images, a fixed paper guiding means 17 for guiding the paper that is detached from the image transferring drum 9 to the toner image fixing section, and a discharged paper guiding means 18 for guiding the paper carrying a fixed color image thereon to an exit port of the apparatus. The paper guiding means 15 includes a registered paper guiding means 15*a* for guiding a paper from the paper tray to a registration (abbreviated frequently as regi.) roll 16, and an upper chute 15*b* and an under chute 15*c* for transporting the paper from the regi. roll 16 to the attracting-transferring position. The upper chute 15*b* is integral with the air duct 8.

In the image forming apparatus, the photoreceptor 1, the charging scorotron 2, the pre-transfer charging corotron 5, the air duct 8 (upper chute 15*b*), the pre-cleaning discharging corotron 6, the photoreceptor cleaning means 7, and the like are assembled into a photoreceptor cartridge. The image transferring drum 9, the regi. roll 16, the under chute 15*c*, the attracting-transferring corotron 10, the detachment means 11, the discharging corotron 12, the fixed paper guiding means 17, the toner image fixing section (13, 14), the discharged paper guiding means 18, and the like are assembled into an image transferring cartridge. These cartridges are detachably set to the main body of the image forming apparatus.

In the full color image forming apparatus, the photoreceptor 1 is uniformly charged, the photoreceptor 1 is exposed to light containing image information to form a latent image on the photoreceptor 1, the latent image is developed with toner of predetermined colors to form toner images on the photoreceptor 1, and the charged potentials of the toner images are adjusted to form predetermined toner images. During this process, a paper is transported from the paper tray to the regi. roll 16 by means of registered paper guiding means 15*a*.

Subsequently, the paper is transported to the attracting-transferring position in synchronism with the timing at which the toner image that is moved forward with the turn of the photoreceptor 1 reaches the attracting-transferring position. The attracting-transferring corotron 10 is operated to transfer the toner image on the paper in a state that the paper is attracted onto the image transferring drum 9.

To form a multi-color image or a full color image, the paper is transported to the attracting-transferring position a predetermined number of times by turning the image transferring drum 9. Each toner image is formed on the photoreceptor 1 in synchronism with the timing at which the paper reaches the attracting-transferring position.

Finally, the paper carrying (multi-color) toner image formed thereon is detached from the image transferring drum 9, and transported to the toner image fixing section (13, 14) by way of the fixed paper guiding means 17. In the toner image fixing section (13, 14), the toner image is fixed on the paper to form a (color) picture thereon. The paper with the picture formed thereon is discharged out of the apparatus by way of the discharged paper guiding means 18.

Each time the toner image is transferred onto the paper, the surface of the photoreceptor 1 is cleaned by the combination of the pre-cleaning discharging corotron 6 and the photoreceptor cleaning means 7 in preparation for the next toner image formation process. Each time the paper is detached from the image transferring drum 9, the image transferring drum is cleaned by the discharging corotron 12 in preparation for the next transferring of the toner image onto another paper.

In the present embodiment, a first optical detecting device 19 is provided close to the regi. roll 16 while facing the registered paper guiding means 15*a*. The first optical detecting device 19 detects a paper transported to the regi. roll 16. A second optical detecting device 20 for detecting a paper transported to the attracting-transferring position is provided between the regi. roll 16 and the attracting-transferring position. A third optical detecting means 21 for detecting a paper after it passes the attracting-transferring position is provided between the attracting-transferring position and the detachment means 11. A fourth optical detecting means 22 is provided close to the fixed paper guiding means 17. The fourth optical detecting means detects a paper transported from the image transferring drum 9 to the toner image fixing section (13, 14). A fifth optical detecting means 23 for detecting a paper attracted onto the image transferring drum 9 is provided between the fixed paper guiding means 17 and the discharging corotron 12.

The output signals of those optical detecting devices are sent to a control unit, not shown, in order to check whether or not a paper is properly transported to properly transport a paper, and whether or not a paper not properly transported is perfectly removed. The output signal of the first optical detecting device 19 is used for properly transporting the paper from the regi. roll 16 to the attracting-transferring position. The output signals of the second optical detecting device 20 and the third optical detecting means 21 are combined to check whether or not the paper is properly transported without being mistakenly attracted to the photoreceptor 1 after it passes the attracting-transferring position. The output signal of the second optical detecting device 20 is used for checking whether or not the paper is perfectly removed after a paper jamming (referred to as a POP jam) is mistakenly attracted to the photoreceptor 1. (Since the paper POP jammed is easily torn when it is removed, tore paper pieces are possibly left on the image transferring drum. It is for this reason that the check by using the output signal of the second optical detecting device 20 is needed.)

Figure 2:
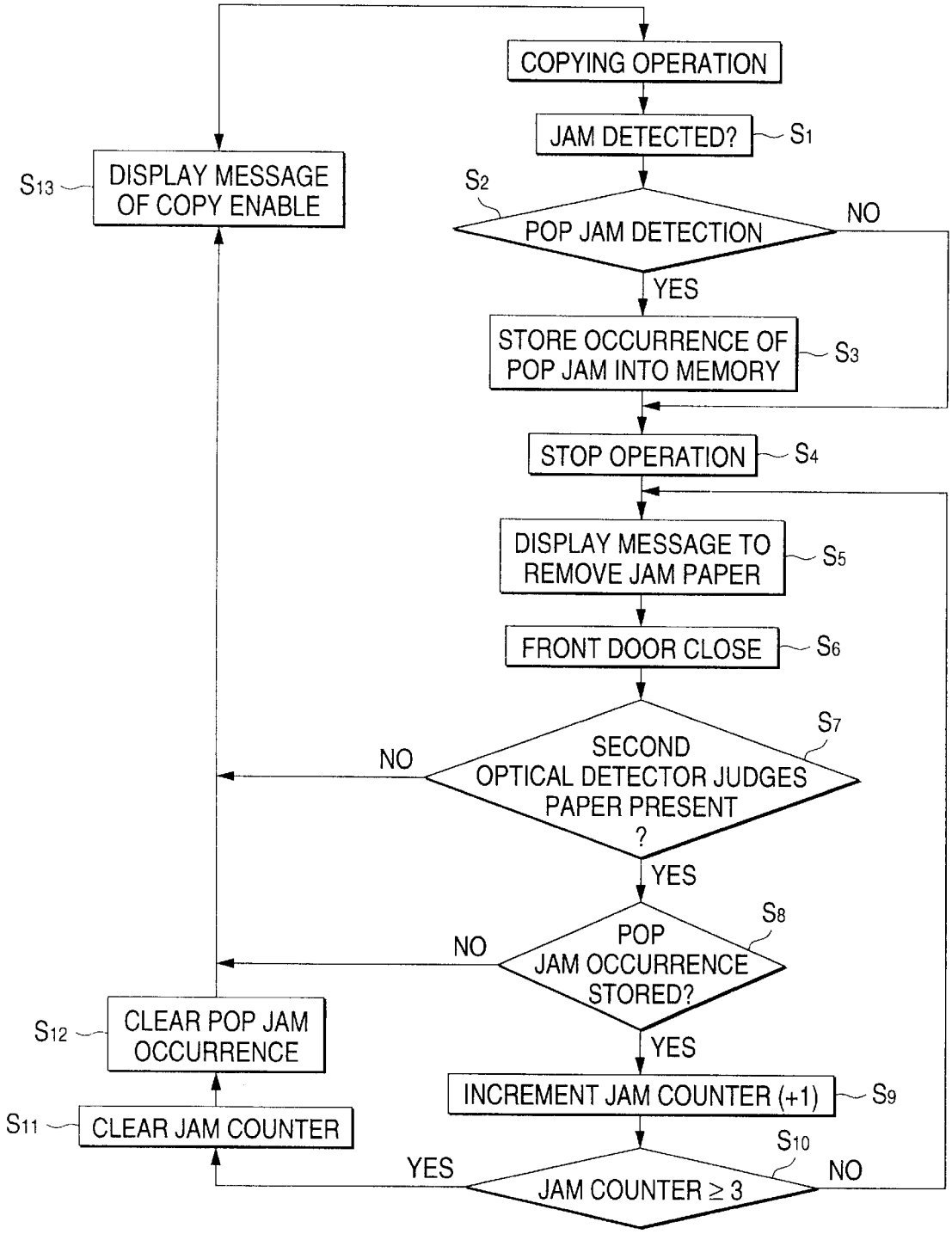
FIG. 2 flow charts a control program used when a POP jam occurs.

In case where the image transferring drum 9 uses an image transferred film and a tie bar 9*a* for fastening both ends of the film, there is a possibility that the second optical detecting device 20, the third optical detecting means 21 and the fifth optical detecting means 23 mistakenly detects the tie bar 9*a* as a paper. In the image forming apparatus using the image transferring drum 9, there are some cases where when those optical detecting devices check whether or not the jammed paper is perfectly removed after a paper jamming takes place, the tie bar 9*a* is mistakenly detected as a paper and the restarting up of the image forming apparatus is impossible. This necessitates a control for discriminating the tie bar 9*a* from the paper in the image forming apparatus using the image transferring drum 9. FIG. 2 flow charts a control program used when a POP jam occurs.

As shown, when a paper jamming occurs during the operation of the image forming apparatus (step S1). A control system that executes the control program judges whether or not the paper jamming is a POP jam (step S2). If the answer is YES (it is the POP jam), the control stores the occurrence of the POP jam into a memory (step S3), and stops the apparatus operation (step S4). Then, the control visually presents a message prompting a user to remove the jammed paper (step S5). The control detects that the front door of the apparatus is closed, and judges that the operation of removing the jammed paper has been made (step S6). The control checks if the second optical detecting device 20 judges that the paper is present (step S7). If it judges that no paper is present, the control visually presents a message describing that the image forming operation is possible (step S13). In the control program, when the control checks if the second optical detecting device 20 judges that the paper is present (step S7), the control checks if data of POP jam occurrence is stored in the memory (step S8), and if such data is not stored, the control visually presents a message describing that the image forming operation is possible (step S13) and returns to a start point of the control program. If the data of POP jam occurrence is stored (step S8), a jam counter is incremented by one (step S9), and checks if the count of the counter is 3 or larger (step S10). If it is smaller than 3, the control visually presents the paper-removal prompting message (step S5). If the count of the counter is 3 or larger (step S10), the control resets the jam counter and deletes the data of POP jam occurrent (steps S11 and S12), and visually presents the message that the image forming operation is possible (step S13) and returns to the start point of the control program. Thus, the control programs causes the image forming apparatus to recognize that an object that detected by the second optical detecting device 20 is the tie bar 9*a* by causing the user to confirm that the paper is perfectly removed three times, and enables the apparatus to be started up again.

The control program is designed on the presumption that the power switch of the apparatus is not turned off after the POP jam occurs. Actually, the power switch is often turned off before the paper is removed, however. To secure a reliable check as to whether or not the paper is perfectly removed after the POP jam occurs, it is necessary to detect the paper by the optical detecting device after the power switch is turned on.

If the image forming operation starts again in a state that the paper is left in the apparatus after the POP jam occurs, the paper enters the pre-cleaning discharging corotron 6 or the photoreceptor cleaning means 7. Serious problems will arise. For example, the corotron wire is cut, the paper twines around the cleaning brush, the cleaning blade is damaged or gets turned up and the like. In this state, the cleaning operation is abnormal, so that the picture reproduced is poor.

The second optical detecting device 20 located between the regi. roll 16 and the attracting-transferring position is used for detecting a POP jam in cooperation with the third optical detecting means 21, and also for checking that the jammed paper is removed. The paper delivered from the regi. roll 16 may be POP jammed or the paper attracted onto the image transferring drum 9 may be POP jammed. The papers of large and small size are used, such as the papers of A3 and B5. For this reason, the second optical detecting device 20 is capable of detecting the papers on two paper transporting paths, and must be disposed close to the attracting-transferring position.

Two transmission type paper detecting means may be used for the second optical detecting device 20. In this case, the number of the paper detecting means is increased, and photo diodes as the paper detecting means must be disposed in a narrow space between the two paper transporting paths. In the full color image forming apparatus, when a paper of which the length is shorter in the paper transporting direction, such as a paper of B5 size, is POP jammed, it is impossible to locate the transmission type optical detecting devices 20 close to the attracting-transferring position to such an extend as to detect the jammed paper.

However, the problem may be solved when the second optical detecting device 20 is constructed according to the present invention.

Figure 3:
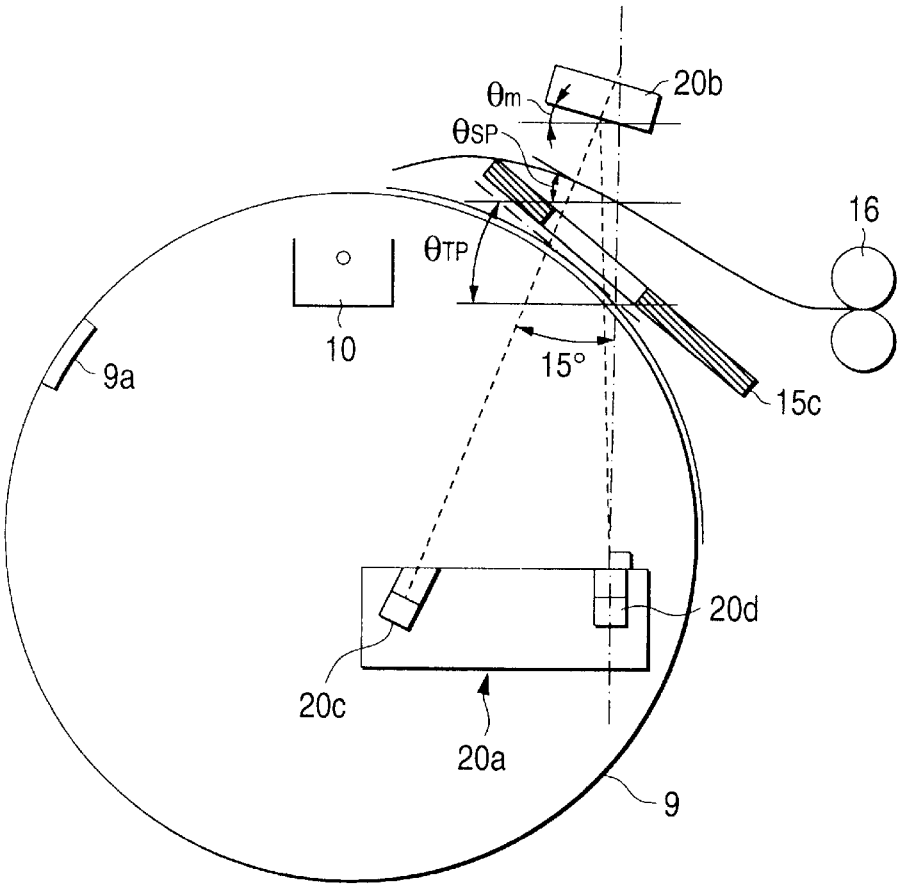
FIG. 3 is a cross sectional view showing a part of the full color image forming apparatus.

The second optical detecting device 20 of the invention, as shown in FIG. 3, is composed of an active member 20*a* including a photo diode 20*c* and a photo sensor 20*d,* and a reflecting member 20*b* disposed in opposition to the active member 20*a.*

In the active member 20*a,* the photo diode 20*c* is located at the back of a slit slanted 15° with respect to the normal line of the reference surface of the active member 20*a.* The photo sensor 20*d* is located at the back of a slit parallel to the normal of the reference surface of the active member 20*a.* A line that passes through the center of the sensing face of the photo sensor 20*d* and is vertical to the reference surface of the active member 20*a* (in FIG. 3) is called a sensing axis of the photo sensor 20*d.*

In the active member 20*a,* the photo diode 20*c* is located within the slit. Accordingly, light emitted from the photo diode 20*c* has a high directivity. The major light beams emitted therefrom are within a narrow range as indicated by dotted lines in FIG. 1. Further, the photo sensor 20*d* is disposed within the slit. The light received by the photo sensor 20*d* has also a high directivity. The photo sensor 20*d* receives mainly the light beams about the line indicated by a one-dot chain line in FIG. 3.

The reflecting member 20*b* has a two-layered structure consisting of a mirrored reflecting surface made of aluminum and a semi-transparent layer (Mending Tape (trade mark) by Sumitomo 3M Corporation in Japan) layered on the reflecting surface. The semitransparent layer of the reflecting member 20*b* has such a function as to suppress a variation of reflecting light, which is caused by a deviation from the correct orientation of the reflecting surface, by increasing the quantity of the scattered reflection light to thereby suppress a variation of the reflecting light in a predetermined direction, which is caused by a minute angle variation of the orientation the reflecting surface.

In the full color image forming apparatus, the second optical detecting device 20 is located in the vicinity of a place where the direction maximizing the quantity of light emitted from the photo diode 20*c* intersects the direction maximizing the quantity of light received by the photo sensor 20*d.* The paper transporting path is disposed while being spaced from the reflecting member 20*b.* To this end, a part of the upper chute 15*b* is incurved in cross section, and the reflecting member 20*b* is placed in the incurved portion of the upper chute 15*b.* Incidentally, the distance from the intersection of the sensing axis of the sensor and the reflecting surface of the reflecting member 20*b* is 64.8 mm, and the distance from the intersection of the sensing axis of the sensor to the paper delivered from the regi. roll 16 to the reference surface is 54.9 mm. The distance from the intersection of the paper attracted to the image transferring drum to the sensing axis of the sensor to the reference surface is 31.0 mm.

In the image forming apparatus, the reflecting member 20*b* is disposed such that the photo sensor 20*d* is positioned in the direction maximizing the quantity of light reflected from the reflecting member 20*b,* and the paper transporting paths are disposed such that the photo sensor 20*d* is not positioned in the direction maximizing the quantity of light reflected from each paper. To this end, an angle of the reflecting surface of the paper in each paper transporting path to the plane vertical to the direction maximizing the quantity of light received by the photo sensor 20*d* is set at 17° or larger. An angle of the reflecting surface of the reflecting member 20*b* to the plane vertical to the direction maximizing the quantity of light received by the photo sensor 20*d* is set at 8°. The angle of the angle of the reflecting surface of the paper delivered from the regi. roll 16 to the plane vertical to the direction maximizing the quantity of light received by the photo sensor 20*d* is smaller than the angle of the reflecting surface of the paper attracted to the image transferring drum to the plane vertical to the direction maximizing the quantity of light received by the photo sensor 20*d.* Therefore, the former angle is set at 17°.

When the light received by the second optical detecting device 20 lowers in its quantity, the second optical detecting device 20 judges that the paper is present. The active member 20*a* is fastened to an L-shaped steel of the bearing of the image transferring drum 9. In case of the full color image forming apparatus, when the second optical detecting device 20 is installed, a through-hole to permit light to go to the under chute 15*c* is formed therein.

In the second optical detecting device 20, the reflecting member 20*b* is located in the vicinity of a place where the direction maximizing the quantity of light emitted from the photo diode 20*c* intersects the direction maximizing the quantity of light received by the photo sensor 20*d.* The reflecting member 20*b* is oriented such that the photo sensor 20*d* is positioned in the direction maximizing the quantity of light reflected from the reflecting member 20*b.* The paper transporting path is disposed while being spaced from the reflecting member 20*b.* The paper transporting paths are oriented such that the photo sensor 20*d* is not positioned in the direction maximizing the quantity of light reflected from each paper. Therefore, the difference between the quantity of light from the reflecting member 20*b* that is received by the reflecting member 20*b* and the quantity of light from the paper that is received by the photo sensor 20*d* may be broadened when comparing with the case where the reflecting member and the paper transporting paths are disposed in the same direction at the same place.

Even if an error of the relative position of the active member 20*a* to the reflecting member 20*b* is large and an error of the orientation of the reflecting member 20*b* to the reflecting member 20*b* is large, a is large enough to detect the paper, in the second optical detecting device 20.

If the active member 20*a* is disposed in the image transferring cartridge and the reflecting member 20*b* is disposed in the photoreceptor cartridge, and if these cartridges are respectively replaced with new ones, the received light quantity difference, i.e., the difference between the quantity of light, which is reflected by a paper of the reflectivity close in value to that of the reflecting member 20*b* and received by the photo sensor 20*d,* and the quantity of light, which is reflected by the reflecting member 20*b* and received by the photo sensor 20*d,* is large enough to detect the paper. In other words, the second optical detecting device 20 can secure such a received light quantity difference even in such a case.

The active member 20*a* and the reflecting member 20*b* may be installed such that the former is placed in one cartridge and the latter, in another cartridge. Accordingly, if either of the active member 20*a* and the reflecting member 20*b* becomes defective, the replacement of only the defective one will do. In other words, in such a case, there is no need of replacing the whole second optical detecting device with a new one.

In the image forming apparatus, an angle of the reflecting surface of the paper delivered from the regi. roll 16 to the plane vertical to the direction maximizing the quantity of light received by the photo sensor 20*d,* and an angle of the reflecting surface of the reflecting member 20*b* to the plane vertical to the direction maximizing the quantity of light received by the photo sensor 20*d* were determined on the basic experiments given hereunder.

Reference is first made to FIG. 3. In the first experiment, when the reflecting surface of the reflecting member 20*b* is turned about a point where the sensing axis of the sensor intersects the reflecting surface of the reflecting member 20*b,* a variation of an output voltage (V) of the photo sensor with respect to an angle (θm) of the reflecting surface of the reflecting member 20*b* and the vertical plane oriented in the direction maximizing the quantity of light received by the photo sensor 20*d,* was measured for specific reflecting members.

In the second experiment, when the reflecting surface of the paper is turned about a point where the sensing axis of the sensor intersects the reflecting surface of the paper delivered from regi. roll 16, a variation of an output voltage (V) of the photo sensor with respect to an angle (θsp) of the reflecting surface of the paper and the vertical plane oriented in the direction maximizing the quantity of light received by the photo sensor 20*d,* was measured for specific reflecting members.

In the first experiment, the measurement was made on a reflecting member 20*b* consisting of a mirror finished, reflecting surface of aluminum and a semitransparent film adhering onto the reflecting surface, and another reflecting member 20*b* consisting of a mirror finished, reflecting surface of aluminum alone. In the second experiment, the measurement was made on a glossy, color copy paper with a coating layer formed thereon and a high density image formed thereon, and a normal white copy paper.

Figure 4:
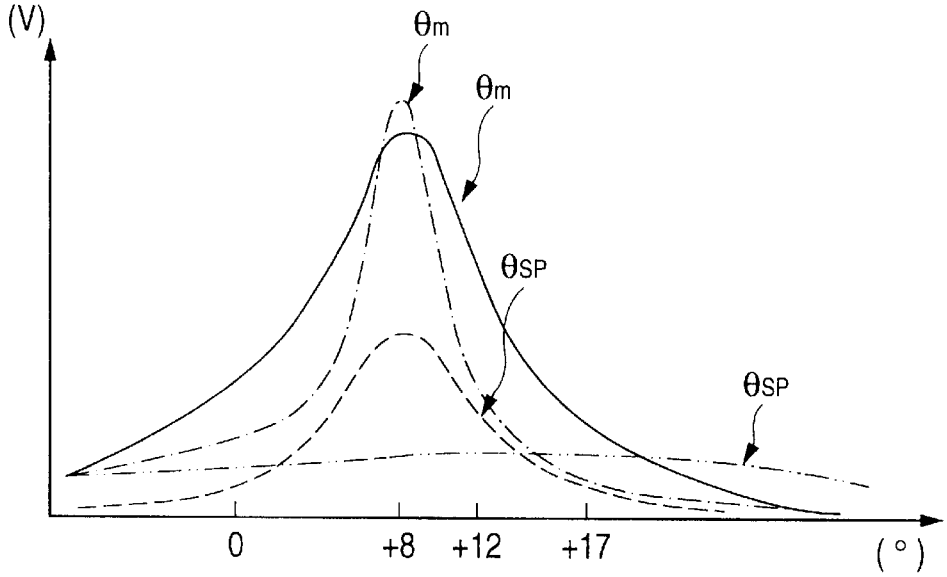
FIG. 4 is a graph showing variations of the output voltage of a photo sensor with respect to the orientations of a reflecting member and a paper.

The results of the measurements in the basic experiments are as shown in FIG. 4. With regard to the reflecting member 20*b,* when the angle (θm) of the reflecting surface of the reflecting member 20*b* and the vertical plane oriented in the direction maximizing the quantity of light received by the photo sensor 20*d,* is +8°, the regular reflection component by the reflecting member 20*b* was incident on the photo sensor 20*d,* and the photo sensor produced a maximum output voltage. This fact was confirmed irrespective of the kind of the reflecting member 2O*b*. With regard to the color copy paper, the angle (θsp) of the reflecting surface of the paper and the vertical plane oriented in the direction maximizing the quantity of light received by the photo sensor 20*d* was +8°, the photo sensor 20*d* produced a maximum output voltage in response to the light reflected by the paper. With regard to the black-white copy paper, the angle (θsp) of the reflecting surface of the paper and the vertical plane oriented in the direction maximizing the quantity of light received by the photo sensor 20*d* was +12°, the photo sensor 20*d* produced a maximum output voltage in response to the light reflected by the paper. The output voltage of the photo sensor 20*d* that is produced in response to the light reflected by the color copy paper was abruptly dropped in the range of +8° to +17°.

In the full color image forming apparatus, on the basis of those measuring results, the angle (θm) of the reflecting surface of the reflecting member 20*b* and the vertical plane oriented in the direction maximizing the quantity of light received by the photo sensor 20*d,* was set at +8°, and the angle (θsp) of the reflecting surface of the paper and the vertical plane oriented in the direction maximizing the quantity of light received by the photo sensor 20*d* was set at +17° so as to maximize the difference between the output voltage (V) of the photo sensor 20*d* when it receives light reflected by the reflecting member 20*b* and the output voltage (V) of the same when it receives light reflected by the paper.

Second Embodiment

Figure 5:
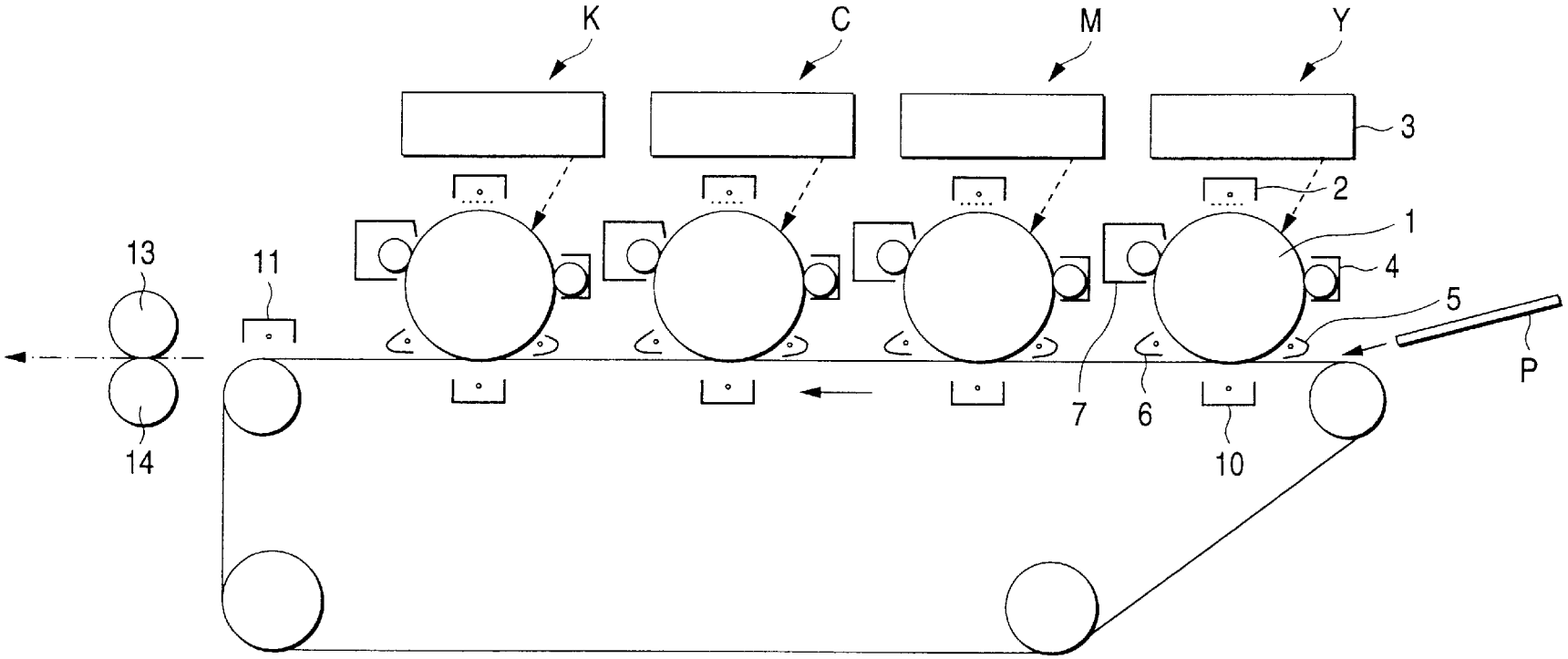
FIG. 5 is a front view showing a key portion of a full color image forming apparatus of the tandem type according to a second embodiment of the present invention.

FIG. 5 is a front view showing a key portion of a full color image forming apparatus of the tandem type according to a second embodiment of the present invention.

The image forming apparatus is composed of four toner image forming sections Y, M, C and K, toner image transferring sections, and a toner image fixing section. The toner image forming sections form toner images of yellow, magenta, cyan and black, respectively. The toner image transferring section is disposed facing the toner image forming sections Y, M, C and K and form color toner images onto an incoming paper P at the image transferring positions thereof. The toner image fixing section fixes the color toner images on the paper P in the form of a color picture.

Each toner image forming section includes a photoreceptor 1 in the form of a drum, a charging scorotron 2 for uniformly charging the surface of the photoreceptor 1 to set up a potential uniformly distributed over the surface of the photoreceptor 1, an exposure means 3 for forming a latent image on the photoreceptor 1 by irradiating the drum surface with light containing image information, a rotary type developing means 4 for developing the latent image with toner of predetermined colors to form color toner images, a pre-transfer charging corotron 5 for adjusting the charged potentials of the toner images, a pre-cleaning discharging corotron 6 for discharging the toner left on the photoreceptor drum 1 after the toner images are transferred from the photoreceptor drum 1 onto a paper, and a photoreceptor cleaning means 7 for removing the residual toner from the surface of the photoreceptor drum 1.

The toner image transferring section includes an image transferring belt 9, four transferring corotrons 10 for transferring the toner images onto the paper P attracted to the belt 9, the corotrons 10 being respectively disposed in opposition to the photoreceptor drums 1 with respect to the image transferring drum 9, and a detachment means 11 for detaching the paper P carrying the multi-color image off the image transferring belt 9. A position between each photoreceptor 1 and the image transferring belt 9 will be referred to as an image transferring position, and a position where the detachment means 11 faces the image transferring belt 9 will be called a detachment position.

The toner image fixing section includes a heating roll 13 containing a heater therein, and a pressure roll 14 pressed against the heating roll 13.

Figure 6:
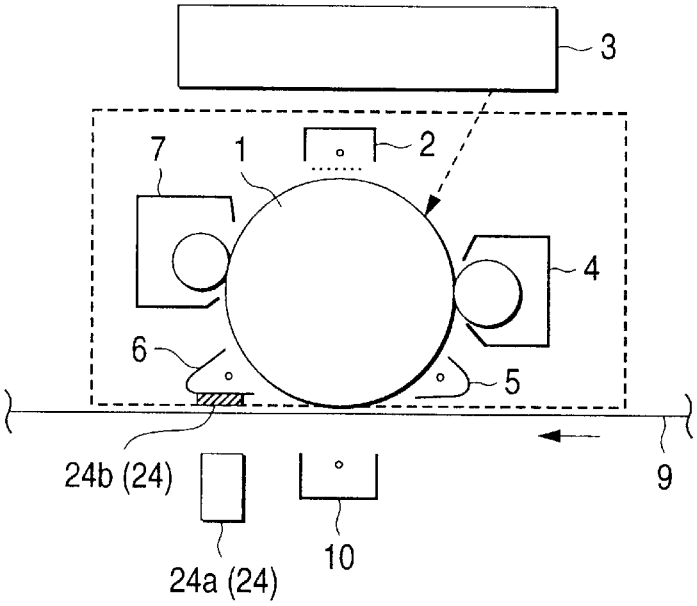
FIG. 6 is a front view showing the transmission type of optical detecting device used in the image forming apparatus of FIG. 5.

In the image forming apparatus, the photoreceptor drums 1, the charging scorotrons 2, the developing means 4, the pre-transfer charging corotrons 5, the pre-cleaning discharging corotrons 6, and the photoreceptor cleaning means 7, respectively, are assembled into photoreceptor cartridges (one cartridge is typically shown and enclosed by a broken line in FIG. 6). The image transferring belt 9, the four attracting-transferring corotrons 10, and the detachment means 11 are assembled into an image transferring cartridge. These cartridges are detachably set to the main body of the image forming apparatus.

In the full color image forming apparatus of the tandem type, in each toner image forming section, the photoreceptor drums 1 are uniformly charged, the photoreceptor drums 1 are exposed to light containing image information to form a latent images on the photoreceptor drums 1, the latent images are developed with toner of predetermined colors to form toner images on the photoreceptor 1, and the charged potentials of the toner images are adjusted to form predetermined toner images. During this process, a paper is attracted onto the image transferring belt 9 in the toner image forming section, the toner images are sequentially transferred onto the paper P at the respective image transferring positions, to thereby form a multi-color image on the paper P. The operations of forming the toner images are performed in synchronism with the timings of arrival of the paper P at the respective image transferring positions.

In the full color image forming apparatus of the tandem type, the paper P with the (multi-color) toner image formed thereon is detached from the image transferring belt 9, the paper P is transported to the toner image fixing section (13, 14), and the toner image fixing section (13, 14) fixes the toner images on the paper P to form a picture thereon.

Every time each toner image is transferred, each photoreceptor 1 is cleaned by the combination of the pre-cleaning discharging corotron 6 and the photoreceptor cleaning means 7 in preparation for the next toner image formation.

Figure 7:
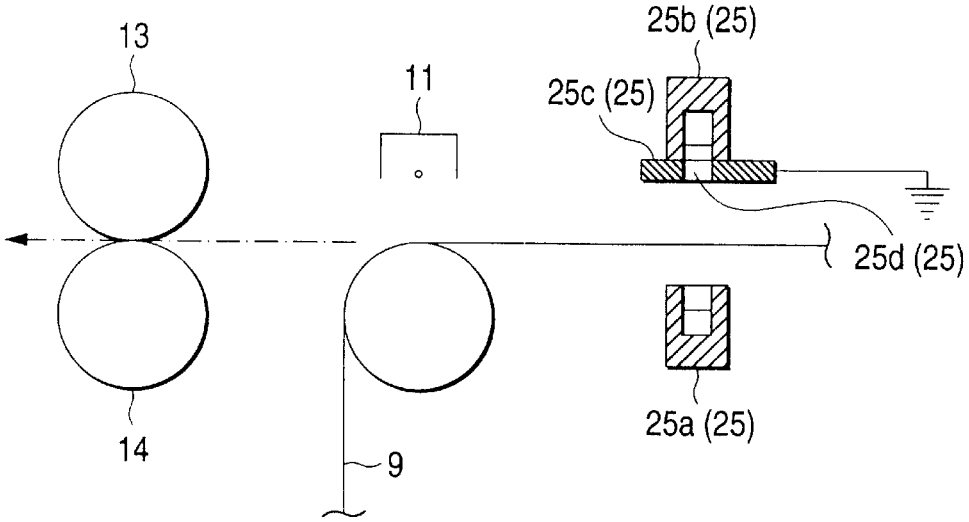
FIG. 7 is a front view showing the reflection type of optical detecting device used in the image forming apparatus of FIG. 5.

In the image forming apparatus of the present embodiment, a reflection type of optical detecting device 24, as shown in FIG. 6, is disposed facing the image transferring belt 9 after it passes the image transferring positions, and a transmission type of optical detecting device 25, as shown in FIG. 7, is disposed facing the image transferring belt 9 immediately before the detachment position.

The reflection type optical detecting device 24 is composed of a reflecting means 24*b* provided on the surface of the casing of the pre-cleaning discharging corotron 6 where it faces the image transferring belt 9, and an active member 24*a* disposed in opposition to the reflecting means 24*b*. The active member 24*a* is constructed as in the first embodiment, and the reflecting means 24*b* consists of a glossy resin layer formed on an aluminum reflecting surface mirror-face finished.

The transmission type optical detecting device 25 is composed of a light emitting means 25*a* disposed on the inside of the image transferring belt 9, a photo sensing means 25*b* disposed in opposition to the light emitting means 25*a* with respect to the image transferring belt 9, and an attracting means 25*c* disposed close to the photo sensing means 25*b*. The light emitting means 25*a* is a photo diode, and the photo sensing means 25*b* is a photo sensor in this instance.

The attracting means 25*c* is a conductive plate which is earthed and disposed between the image transferring belt 9 and the photo sensing means 25*b*. An opening 25*d* is formed in the conductive plate at a location thereof corresponding to the light emitting means 25*a*. With provision of the opening 25*d*, an optical path for paper detection is continuous without any interruption.

A test was conducted. In the test, the tandem type of image forming apparatus was used for image formation, and the photoreceptor cartridges were replaced with new ones. Adhesion of great dirt onto the surfaces of the optical means of the optical detecting device 24, viz., the reflecting means 24*b*, the light emitting means and the photo sensing means, was not observed. The optical detecting device 24 was normally operable for a long time. By replacing its cartridge, the reflecting means 24*b* of the optical detecting device 24 was periodically replaced with another. Therefore, the work to replace the individual reflecting means 24*b* and the maintenance of the reflecting means 24*b* were not required.

Another test was conducted. In the test, the same image forming apparatus as in the first test was used. Dust floating in the vicinity of the photo sensing means 25*b* of the optical detecting device 25 electrostatically stuck to the attracting means 25*c*. It was confirmed that no dirt stuck to the surfaces of the photo sensing means 25*b* and the light emitting means 25*a* for a long time. The interval of removing dirt from the surfaces of the light emitting means 25*a* and the photo sensing means 25*b* and of replacing the optical means with another was remarkably increased.

Figure 8:
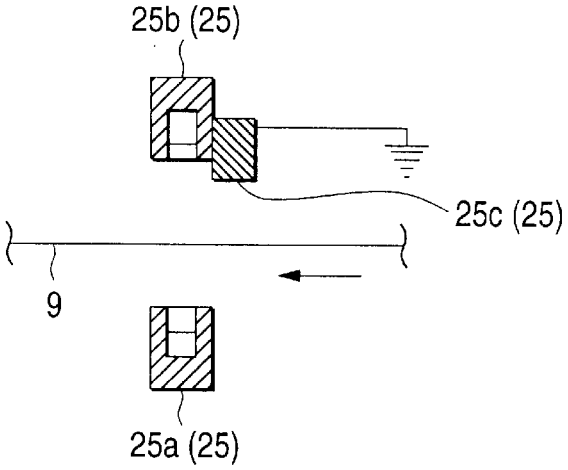
FIG. 8 is a front view showing a modification of the reflection type of optical detecting device.
Figure 9:
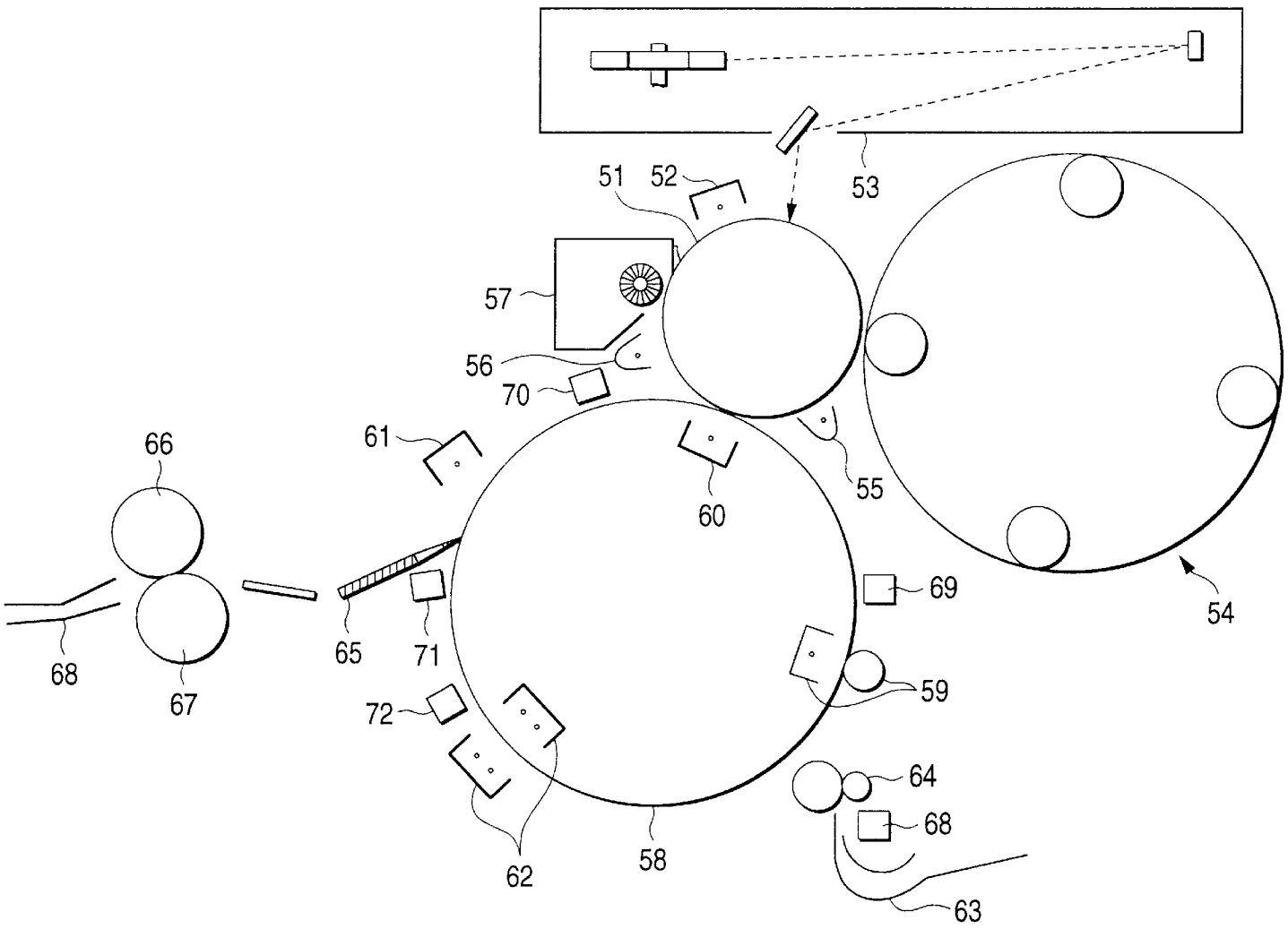
FIG. 9 is a front view showing a conventional image forming apparatus and a conventional optical detecting device assembled thereinto.

Alternatively, the optical detecting device 25 may be modified such that, as shown in FIG. 8, the attracting means 25*c* is located only upstream of the photo sensing means 25*b* in the rotating direction of the image transferring belt 9.

As described above, in the optical detecting device for an image forming apparatus of the first aspect of the invention, the conductive attracting means connected to a predetermined potential is disposed close to the optical means. The attracting means electrostatically attracts dusty particles including toner floating in the space near the optical means. Floating toner, for example, hardly adheres to the surface of the surface of the optical means. With this fact, the ability of the optical means to correctly detect a detected object is ensured for a long time. The fact also provides a considerable elongation of the interval of the maintenance of the optical means and the replacement of the optical means with another.

In the optical detecting device for an image forming apparatus of the second aspect of the invention, the optical means is attached to a periodical replacing component of the image forming apparatus. Accordingly, the optical means can be replaced with a new one by replacing the periodical replacing component with a new one. The optical means is periodically replaced with a new one, so that floating dusty material, for example, toner, hardly adheres to the surface of the optical means. Accordingly, the ability of the optical means to correctly detect a detected object is ensured for a long time. Further, in the optical detecting device, there is successfully eliminated the work to replace the optical means with another and to maintain the optical means since the optical means is replaced with a new one by replacing the periodical replacing component with a new one.

In the optical detecting device for an image forming apparatus of the third aspect of the invention, the reflecting means is disposed such that the photo sensing means is positioned in the direction maximizing a quantity of light reflected by the reflecting means, and the paper transporting path is disposed such that the photo sensing means is not positioned in the direction maximizing a quantity of light reflected by the paper, whereby a difference between the quantity of light reflected by-the reflecting means and the quantity of light reflected by the paper, both reflecting light being received by the photo sensing means, is increased. With this construction, the optical detecting device exactly detects a paper of which the reflectivity is substantially equal to that of the optical means. Further, since the difference between the quantity of light reflected by the reflecting means and the quantity of light reflected by the paper, both reflecting light being received by the photo sensing means, is increased, a necessary difference of the quantity of reflecting light can be secured even if the optical means is roughly positioned relative to other means.

In the optical detecting device for an image forming apparatus of the forth aspect of the invention, the reflecting means is located at or in the vicinity of a place where the direction maximizing the quantity of light emitted from the light emitting means intersects the direction maximizing the quantity of light received by the photo sensing means, and the paper transporting path is disposed while being spaced from the reflecting means. With the construction, the difference between the quantity of light reflected by the reflecting means and the quantity of light reflected by the paper, both reflecting light being received by the photo sensing means, is increased. Therefore, the optical detecting device exactly detects a paper of which the reflectivity is substantially equal to that of the optical means. Since the difference between the quantity of light reflected by the reflecting means and the quantity of light reflected by the paper, both reflecting light being received by the photo sensing means, is increased, a necessary difference of the quantity of reflecting light can be secured even if the optical means is roughly positioned relative to other means.

In the optical detecting device for an image forming apparatus, the reflecting means has a structure that a semi-transparent layer is formed on the reflecting surface of the reflecting plate, to thereby suppress a variation of the reflecting light in a predetermined direction, which is caused by a minute angle variation of the orientation of the reflecting surface. Therefore, the light emitting means, the photo sensing means and the reflecting means may be mutually placed at a relatively rough position accuracy.

Additionally, an orientation accuracy of the reflecting means relative to the light emitting means and the photo sensing means may be relatively rough. Accordingly, there is no need of adjusting the mutual positions and orientations of those optical means.

In the image forming apparatus, the reflecting means is assembled into a cartridge that is different from that of the light emitting means and the photo sensing means. Accordingly, if one of those means is abnormal, only the abnormal means, not the whole optical detecting device, can be replaced with a normal one. Further, after the replacement of only the abnormal optical means, the optical detecting device is normally operable for paper detection without any mutual adjustment of the light emitting means, the photo sensing means and the reflecting means.

In the image forming apparatus, the reflecting means of the optical detecting device may be disposed facing the light emitting means and the photo sensing means with respect to a paper transporting path for a paper attracted to the image transferring means, and the paper transporting path for a paper attracted to the image transferring means or a paper transporting path for a paper detached from the image transferring means. Therefore, the number of optical detecting devices used for an image forming apparatus can be reduced. Further, the optical detecting device is disposed closer to the attracting position where the paper is attracted to the image transferring means or the detachment position where the paper is detached from the image carrying means since the reflecting means of the optical detecting device may be disposed facing the light emitting means and the photo sensing means with respect to a paper transporting path for a paper attracted to the image transferring means, and the paper transporting path for a paper attracted to the image transferring means or a paper transporting path for a paper detached from the image transferring means.

In the image forming apparatus, the reflecting means of the optical detecting device is disposed facing the light emitting means and the photo sensing means with respect to a paper transporting path for a paper attracted to the image transferring means and a paper transporting path for a paper to be attracted to the image transferring means, or the paper transporting path for a paper attracted to the image transferring means and a paper transporting path for a paper detached from the image transferring means, and the optical detecting device detects the paper after the paper twined around the image carrying means is removed from the image carrying means and/or after the power switch of the image forming apparatus is turned on. Therefore, it is possible to check as to whether or not the paper which twines around the image carrying means is surely removed from the image carrying means. Accordingly, further trouble that may be caused by the paper will not occur.

What is claimed is:

1. An optical detecting device for an image forming apparatus, which optically detects an object by optical means, said device disposed facing a moving path of the detected object, said optical detecting device comprising:

conductive attracting means connected to a predetermined potential and disposed close to said optical means.

2. An optical detecting device according to claim 1, wherein said optical means is attached to a periodically replaced component of the image forming apparatus.

3. An optical detecting device for an image forming apparatus comprising:

conductive attracting means connected to a predetermined potential and disposed close to an optical means;

light emitting means disposed facing a paper transporting path;

reflecting means for reflecting light emitted from said light emitting means by the reflecting surface thereof, said reflecting means being disposed in opposition to said light emitting means with respect to the paper transporting path; and photo sensing means for sensing light reflected by the reflecting surface of said reflecting means, said photo sensing means being disposed in opposition to said reflecting means with respect to the paper transporting path, wherein an optical path for paper detection that intersects the paper transporting path is set up, and presence or absence of a paper is judged depending on a quantity of light received by said photo sensing means, said reflecting means is disposed such that said photo sensing means is positioned in the direction maximizing a quantity of light reflected by said reflecting means, and said paper transporting path is disposed such that said photo sensing means is not positioned in the direction maximizing a quantity of light reflected by the paper.

4. The optical detecting device according to claim 3, wherein said reflecting means includes a two-layered structure consisting of a reflecting plate and a semi-transparent layer layered on said reflecting plate.

5. An optical detecting device for an image forming apparatus comprising:

conductive attracting means connected to a predetermined potential and disposed close to an optical means;

light emitting means disposed facing a paper transporting path;

reflecting means for reflecting light emitted from said light emitting means by the reflecting surface thereof, said reflecting means being disposed in opposition to said light emitting means with respect to the paper transporting path; and photo sensing means for sensing light reflected by the reflecting surface of said reflecting means, said photo sensing means being disposed in opposition to said reflecting means with respect to the paper transporting path, wherein an optical path for paper detection that intersects the paper transporting path is set up, and presence or absence of a paper is judged depending on a quantity of light received by said photo sensing means, said reflecting means is located at or in the vicinity of a place where the direction maximizing the quantity of light emitted from said light emitting means intersects the direction maximizing the quantity of light received by said photo sensing means, and said paper transporting path is spaced apart from said reflecting means.

6. The optical detecting device according to claim 5, wherein said reflecting means includes a two-layered structure consisting of a reflecting plate and a semi-transparent layer layered on said reflecting plate.

7. An image transferring apparatus comprising:

image transferring means;

an optical detecting device coupled to said image transferring means, comprising:

conductive attracting means connected to a predetermined potential and disposed close to an optical means;

light emitting means disposed facing a paper transporting path;

reflecting means for reflecting light emitted from said light emitting means by the reflecting surface thereof, said reflecting means being disposed in opposition to said light emitting means with respect to the paper transporting path; and photo sensing means for sensing light reflected by the reflecting surface of said reflecting means, said photo sensing means being disposed in opposition to said reflecting means with respect to the paper transporting path, wherein an optical path for paper detection that intersects the paper transporting path is set up, and presence or absence of a paper is judged depending on a quantity of light received by said photo sensing means, said reflecting means is disposed such that said photo sensing means is positioned in the direction maximizing a quantity of light reflected by said reflecting means, and said paper transporting path is disposed such that said photo sensing means is not positioned in the direction maximizing a quantity of light reflected by the paper, wherein said light emitting means and said photo sensing means are assembled into a cartridge and said reflecting means of said optical detecting device is assembled into another cartridge, and wherein said image transferring means transfers an image detected by said optical detecting device to a medium.

8. An image transferring apparatus comprising:

image transferring means to and from which a paper is attracted and detached; and an optical detecting device coupled to said image transferring means, comprising:

conductive attracting means connected to a predetermined potential and disposed close to an optical means;

light emitting means disposed facing a paper transporting path;

reflecting means for reflecting light emitted from said light emitting means by the reflecting surface thereof said reflecting means being disposed in opposition to said light emitting means with respect to the paper transporting path;

photo sensing means for sensing light reflected by the reflecting surface of said reflecting means, said photo sensing means being disposed in opposition to said reflecting means with respect to the paper transporting path, wherein an optical path for paper detection that intersects the paper transporting path is set up, and presence or absence of a paper is judged depending on a quantity of light received by said photo sensing means, said reflecting means is disposed such that said photo sensing means is positioned in the direction maximizing a quantity of light reflected by said reflecting means, and said paper transporting path is disposed such that said photo sensing means is not positioned in the direction maximizing a quantity of light reflected by the paper, wherein said light emitting means and said photo sensing means are assembled into a cartridge and said reflecting means of said optical detecting device is assembled into another cartridge, and wherein said reflecting means of said optical detecting device is disposed facing said light emitting means and said photo sensing means with respect to a paper transporting path for a paper attracted to said image transferring means and a paper transporting path for a paper to be attracted to said image transferring means, or the paper transporting path for a paper attracted to said image transferring means, and a paper transporting path for a paper detached from said image transferring means and wherein said image transferring means transfers an image detected by said optical detecting device to said paper.

9. An image transferring apparatus comprising:

image transferring means to and from which a paper is attracted and detached, said image transferring means being disposed facing the image carrying means;

an optical detecting device coupled to said image transferring means, comprising:

conductive attracting means connected to a predetermined potential and disposed close to an optical means;

light emitting means disposed facing a paper transporting path;

reflecting means for reflecting light emitted from said light emitting means by the reflecting surface thereof, said reflecting means being disposed in opposition to said light emitting means with respect to the paper transporting path;

photo sensing means for sensing light reflected by the reflecting surface of said reflecting means, said photo sensing means being disposed in opposition to said reflecting means with respect to the paper transporting path, wherein an optical path for paper detection that intersects the paper transporting path is set up, and presence or absence of a paper is judged depending on a quantity of light received by said photo sensing means, said reflecting means is disposed such that said photo sensing means is positioned in the direction maximizing a quantity of light reflected by said reflecting means, and said paper transporting path is disposed such that said photo sensing means is not positioned in the direction maximizing a quantity of light reflected by the paper, wherein said light emitting means and said photo sensing means are assembled into a cartridge and said reflecting means of said optical detecting device is assembled into another cartridge; and image carrying means on which a toner image is carried, wherein a toner image is transferred to the paper when the paper is passed through the nip between said image carrying means and said image transferring means, wherein said reflecting means of said optical detecting device is disposed facing said light emitting means and said photo sensing means with respect to a paper transporting path for a paper attracted to said image transferring means and a paper transporting path to a paper to be attracted to said image transferring means, or the paper transporting path for a paper attracted to said image transferring means and a paper transporting path for a paper detached from said image transferring means, and said optical detecting device detects the paper after the paper twined around said image carrying means is removed from said image carrying means and/or after the power switch of said image forming apparatus is turned on.

10. An image transferring apparatus comprising:

image transferring means;

an optical detecting device coupled to said image transferring means, comprising:

conductive attracting means connected to a predetermined potential and disposed close to an optical means;

light emitting means disposed facing a paper transporting path;

reflecting means for reflecting light emitted from said light emitting means by the reflecting surface thereof said reflecting means being disposed in opposition to said light emitting means with respect to the paper transporting path; and photo sensing means for sensing light reflected by the reflecting surface of said reflecting means with respect to the paper transporting path, wherein an optical path for paper detection that intersects the paper transporting path is set up, and presence or absence of a paper is judged depending on a quantity of light received by said photo sensing means, said reflecting means is located at or in the vicinity of a place where the direction maximizing the quantity of light emitted from said light emitting means intersects the direction maximizing the quantity of light received by said photo sensing means, and said paper transporting path is spaced apart from said reflecting means, wherein said light emitting means and said photo sensing means of said optical detecting device are assembled into a cartridge, and said reflecting means of said optical detecting device is assembled into another cartridge, and wherein said image transferring means transfers an image detected by said optical detecting device to a medium.

11. An image transferring apparatus comprising:

image transferring means to and from which a paper is attracted and detached;

an optical detecting device coupled to said image transferring means, comprising:

conductive attracting means connected to a predetermined potential and disposed close to an optical means;

light emitting means disposed facing a paper transporting path;

reflecting means for reflecting light emitted from said light emitting means by the reflecting surface thereof, said reflecting means being disposed in opposition to said light emitting means with respect to the paper transporting path; and photo sensing means for sensing light reflected by the reflecting surface of said reflecting means with respect to the paper transporting path.

wherein an optical path for paper detection that intersects the paper transporting path is set up, and presence or absence of a paper is judged depending on a quantity of light received by said photo sensing means, said reflecting means is located at or in the vicinity of a place where the direction maximizing the quantity of light emitted from said light emitting means intersects the direction maximizing the quantity of light received by said photo sensing means, and said paper transporting path is spaced apart from said reflecting means, and wherein said reflecting means of said optical detecting device is disposed facing said light emitting means and said photo sensing means with respect to a paper transporting path for a paper attracted to said image transferring means and a paper transporting path for a paper to be attracted to said image transferring means, or the paper transporting path for a paper attracted to said image transferring means and a paper transporting path for a paper detached from said image transferring means and wherein said image transferring means transfers an image detected by said optical detection device to said paper.

12. An image transferring apparatus comprising:

image transferring means to and from which a paper is attracted and detached;

an optical detecting device coupled to said image transferring means, comprising:

conductive attracting means connected to a predetermined potential and disposed close to an optical means;

light emitting means disposed facing a paper transporting path:

reflecting means for reflecting light emitted from said light emitting means by the reflecting surface thereof, said reflecting means being disposed in opposition to said light emitting means with respect to the paper transporting path, and photo sensing means for sensing light reflected by the reflecting surface of said reflecting means with respect to the paper transporting path, wherein an optical path for paper detection that intersects the paper transporting path is set up, and presence or absence of a paper is judged depending on a quantity of light received by said photo sensing means, said reflecting means is located at or in the vicinity of a place where the direction maximizing the quantity of light emitted from said light emitting means intersects the direction maximizing the quantity of light received by said photo sensing means, and said paper transporting path is spaced apart from said reflecting means; and an image carrying means on which a toner image is carried wherein said image transferring means is disposed facing said image carrying means, and a toner image is transferred to the paper when the paper is passed through the nip between said image carrying means and said image transferring means, and wherein said reflecting means of said optical detecting device is disposed facing said light emitting means and photo sensing means with respect to a paper transporting path for paper attracted to said image transferring means and a paper transporting path for a paper to be attracted to said image transferring means, or the paper transporting path for a paper attracted to said image transferring means and a paper transporting path for a paper detached from said image transferring means, and said optical detecting device detects the paper after the paper twined around said image carrying means is removed from said image carrying means and/or after the power switch of said image transferring apparatus is turned on.

* * * * *